United States Patent [19]

Yamaguchi

[11] 4,250,901

[45] Feb. 17, 1981

[54] CIGARETTE HOLDER

[76] Inventor: Takeyoshi Yamaguchi, 20-24, Tsurumaki 5-chome, Setagaya-ku, Tokyo 154, Japan

[21] Appl. No.: 56,428

[22] Filed: Jul. 10, 1979

[30] Foreign Application Priority Data

Sep. 22, 1978 [JP] Japan ..... 53-115823

[51] Int. Cl.[3] ..... A24F 7/04

[52] U.S. Cl. ..... 131/202; 131/265; 131/10 R

[58] Field of Search ..... 131/187, 10.1, 10 R, 131/10.7, 10.9, 265, 261; 423/224, 202, 230, 245 S

[56] References Cited

U.S. PATENT DOCUMENTS 3,911,080 10/1975 Mehl et al. ..... 423/245 S 3,943,940 3/1976 Minami ..... 131/10.1

*Primary Examiner*—Stephen C. Pellegrino

*Attorney, Agent, or Firm*—Leydig, Voit, Osann, Mayer & Holt, Ltd.

[57] ABSTRACT

A cigarette holder with a filtering means capable of chemically denaturing such harmful substances as nicotine, tar and the like and particularly carbon-monoxide gas contained in cigarette smoke to harmless substances, in addition to mechanical trapping of them. The filtering means contains hydrogen peroxide solution preferably of a concentration in a range of 0.5 to 3% and an amount in a range of 0.1 to 0.3 c.c. for achieving the chemical denaturalization.

1 Claim, 3 Drawing Figures

CIGARETTE HOLDER

This invention relates to cigarette holders and, more particularly, to improvements in cigarette holders containing a filtering means for removing or trapping harmful substances contained in smoke of cigarettes.

Generally, it is known that many substances harmful to human bodies are contained in the smoke of cigarettes, and that the main substances are (1) nicotine, (2) tar, (3) carbon-monoxide gas, (4) smoke particles, (5) imperfect-combustion products containing cancer generating substances, and so on. It is said that 20 to 25 mg. of nicotine which is the most important substance are usually contained in one cigarette and about 3 mg. of nicotine will be absorbed in the lungs of the smoker during each smoking. Therefore, in order to remove these harmful substances as much as possible, there are already taken measures wherein a filter made of cotton, acetate fibers, glass fibers or the like porous material is attached to a cigarette or contained in a cigarette holder, alone or as combined either with activated carbon or water, so that smoke will pass through such filter and the harmful substances will be physically trapped as deposited on the filter or dissolved in water. However, it is preferable that the filter is of such density or permeability as will not remarkably prevent the passage of smoke and that the amount of water to be contained in the filter is such that will remain between the fibers due to the capilarity, and the harmful substances cannot be perfectly trapped and will be carried as they are into the smoker's body after passing through the filter without contacting the material forming the filter or water. In particular, these known filters can do nothing about carbon-monoxide gas, and the total amount of generated carbon-monoxide gas is considered to be carried into the smoker's body. The present invention has been suggested to eliminate such defects of the conventional measures.

According to the present invention, there is provided an improved cigarette holder wherein the main harmful substances are chemically denatured and made harmless by a hydrogen peroxide solution contained in a filtering means, as quite different in the idea from the conventional measures wherein the harmful substances are attempted to be mechanically trapped as absorbed or dissolved as they are by the filtering means of fibers or fibers and water.

A primary object of the present invention is, therefore, to provide an improved cigarette holder having a filtering means which can further chemically denature the main harmful substances in cigarette smoke by means of hydrogen peroxide solution.

Other objects and advantages of the present invention will be understood upon reading the following disclosure of the present invention detailed with reference to accompanying drawings, in which.

First of all, actions of hydrogen peroxide $H_2O_2$ used in the present invention shall be described with reference to the respective main harmful substances. When nicotine $C_{10}H_{14}N_2$ reacts with hydrogen peroxide $H_2O_2$, the structure of nicotine will split as shown by the following formula and N-methylpyrrole $C_5H_7N$, pyridine $C_5H_5N$, nicotinic acid $C_6H_5NO_2$ and others will be produced:

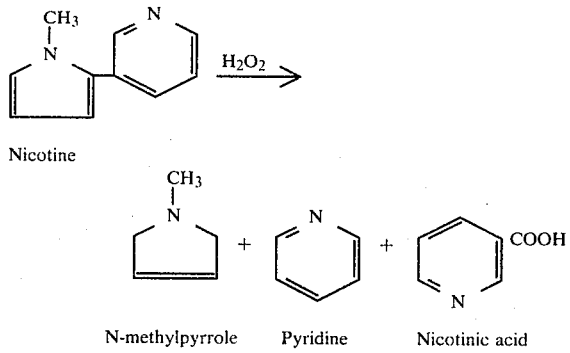

Further, as the carbon monoxide which is particularly harmful as an inorganic compound, it will easily react with $H_2O_2$ to become carbon dioxide and water as represented by the formula $$CO+H_2O_2=CO_2+H_2O$$

and will be made harmless.

For tar, its main ingredient is a hydrocarbon, and it is clear that, when it reacts with $H_2O_2$, a substance easily dissolvable in water will be produced. Therefore, the deposition and dissolution of tar on the filter fibers and in water contained in them will be evidently accelerated with the presence of $H_2O_2$.

The imperfect combustion products will vary in the composition and amount depending on the quality and burning condition of the cigarette but will mostly remain in the filter as deposited or dissolved on the filter material or in water together with the respective substances referred to above. Therefore, the amount of the imperfect combustion products to be removed will also increase in response to the amounts of the above referred substances trapped or denatured by the filter.

Figure 1:
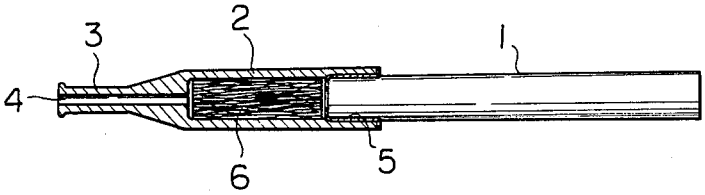
FIG. 1 is a vertically sectioned view of a cigarette holder to be used in the present invention as being used.

Tests have been made to investigate effects of removing the harmful substances in the cigarette smoke by means of the cigarette holder shown in FIG. 1 and having a filter containing a hydrogen peroxide solution which is evident to be effective to render the harmful substances harmless due to such chemical reactions as above, according to the present invention, in addition to the physical trapping by means of the filter and water of the solution. For solid phase substances of nicotine and tar, the testing apparatus as shown in FIGS. 2 and 3 has been used and, for gaseous phase substance of carbon-monoxide gas, a gas chromatograph of a type generally used has been utilized.

In FIG. 1, 1 is a plain cigarette used for the tests and 2 is a cigarette holder similar to a substantially cylindrical conventional one having at one end a mouthpiece 3 which has a small conduit 4 communicating with a hollow chamber of the holder and provided at the other end with a cigarette inserting port 5 communicating with the hollow chamber. This hollow chamber is charged with a filtering member 6 made, for example, of cotton, acetate or the like fibrons or porous material and impregnated with a hydrogen peroxide solution of respective concentrations and amounts later described.

Figure 2:
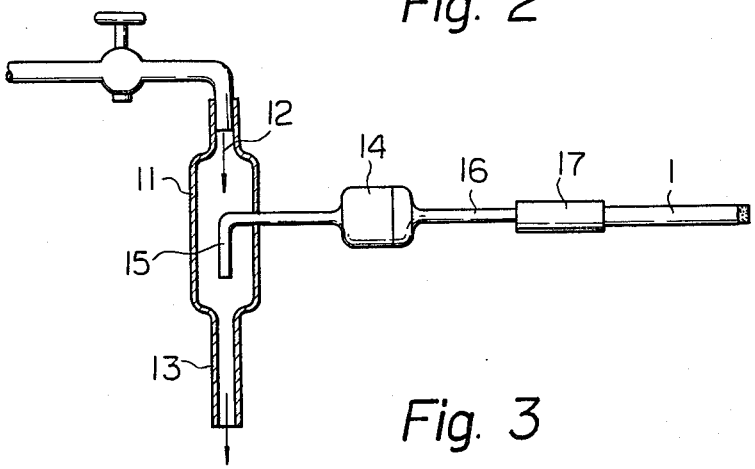
FIG. 2 is a schematic view showing an example of testing apparatus for investigating effects of the filtering means used in the cigarette holder of the present invention.

In the solid phase substance investigating apparatus of FIG. 2, 11 is an aspirator used to suck in combustion smoke of a cigarette, fed with a water current 12 in this case from the upper end and discharging water from the lower end 13. A discharge end of a discharge pipe 15 of a filter supporter 14 used generally to collect fine substances contained in smoke current is inserted substantially in the center of the aspirator 11 and is opened toward the lower end 13. An inlet pipe 16 of the supporter 14 is connected to an end of a supporter 17 for the fiber body 6 impregnated with a hydrogen peroxide solution as used for the cigarette holder of FIG. 1. The cigarette 1 for the test is inserted into the other end of the supporter 17.

Figure 3:
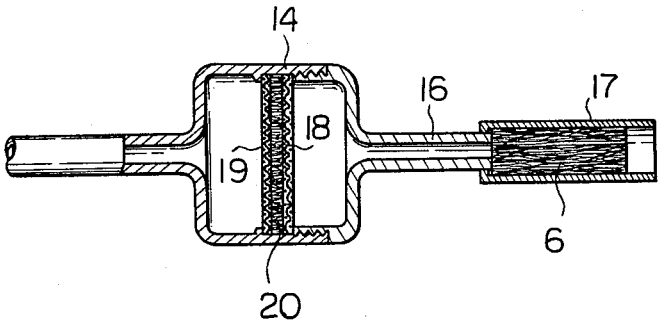
FIG. 3 is a vertically sectioned view of a Cambridge filter supporter and a supporter for the filtering means tested which are used in the apparatus of FIG. 2.

In the filter supporter 14, as shown in FIG. 3, a pair of metal screens 18 and 19 are provided at right angles with respect to the axis of the supporter with a spacing between them substantially in the middle of a cylindrical container and a disk-shaped membrane filter 20 used extensively internationally in this kind of tests and known as a Cambridge filter is held between these metal screens 18 and 19.

In this arrangement, when the cigarette is lighted and the water current 12 is passed through the aspirator 11, a negative pressure is thereby generated at the discharge end of the pipe 15, the combustion smoke of the cigarette 1 will be caused to flow to the collecting filter 20 through the filtering member 6, as if smoked by a person, and will be discharged out of the discharge pipe 15 after passing through the filter 20.

The membrane filter used in this apparatus has a capacity of collecting fine grains of 0.1 micron. Therefore, substantially 100% of fine granular substances contained in the smoke passing through the filter will be collected by the filter. In detecting thus collected substances, the metal screens 18 and 19 holding the filter 20 are removed, the filter is taken out, the minute amount of the substances trapped on the filter is dissolved in a chloroform solution of a concentration of more than 99% and the composition of the substances extracted from such solution is analyzed and detected by means of a chromatograph.

The gas chromatograph used for investigating the carbon-monoxide gas shall not be detailed here since any arrangement widely employed therefor will suffice the purpose.

In the respective tests, a columnar filtering member of a diameter of 8 mm., length of 25 mm. and weight of about 0.1 g. made of acetate fibers was used for the filtering member 6, and a plain cigarette "PEACE" containing no filter and produced by Japan Monopoly Corporation was used for the testing cigarette 1. The results of the tests made by Japan Foodstuff Sanitation Society (a Japanese testing authority appointed by the Health and Welfare Minister) are as in Table 1, in which Sample 1 is a PEACE cigarette test-smoked without using the filtering member 6, Sample 2 is a PEACE cigarette test-smoked with the use of the filtering member 6 containing 0.2 c.c. of an $H_2O_2$ solution of a concentration of 3%, and Sample 3 is a PEACE cigarette with the filtering member 6 containing the same amount of plain water. Samples 1 and 2 were subjected to the investigations of nicotine, tar and carbon-monoxide gas, but Sample 3 was subjected only to that of tar.

TABLE 1

| Sample | Nicotine ( mg. ) | Tar ( mg. ) | CO ( p.p.m. ) |
|---|---|---|---|
| 1 | 2.180 | 16.5 | 350 |
| 2 | 0.204 | 9.0 | 0 |
| 3 | — | 13.8 | — |

As will be clear from the table, it is found that more than about 90% of the amount of nicotine detected on Sample 1 was removed in Sample 2, that nearly half of tar in Sample 1 was removed in Sample 2 and about $\frac{1}{3}$ of tar in Sample 3 was removed in Sample 2, and that carbon-monoxide gas was completely removed in Sample 2.

It has been made clear, therefore, that by the impregnation of a hydrogen peroxide solution in the filtering means a practically epoch-making result could have been achieved in such that nicotine and tar are remarkably removed to a large extent as compared with conventional filtering means and, in addition, carbon-monoxide gas that could have been done nothing conventionally is also removed substantially completely, though the respective values of the harmful substances removed might be varied depending on the amount and concentration of the solution or on other testing conditions.

According to the present invention, nicotine as an important harmful substance and also as a substance important to the taste and flavor of cigarettes is remarkably removed as shown in Table 1 mostly by its chemical reaction with hydrogen peroxide $H_2O_2$ as described above. This removing rate will be different depending on the quality and density of tobacco contained in the cigarette, burning speed of the cigarette, air feeding condition, composition and amount of other impurities, and so on. However, according to experiments made by the present inventor, it is found that, in case the amount of use is 0.2 c.c., about 100% of nicotine will be removed by hydrogen peroxide solution in a concentration of 10%. On the other hand, it is considered that the smoke from which nicotine has been substantially perfectly removed is not always favorable in respect of the taste and flavor. Therefore, the results of experiments made by using a hydrogen peroxide solution of respective different concentrations selected to leave some nicotine after passing through the filtering means in consideration of the test results in Table 1 are shown in Table 2:

TABLE 2

| | | | | |
|---|---|---|---|---|
| $H_2O_2$ Concentration ( % ) | 10 | 3 | 1 | 0.5 |
| Impregnation ( c.c. ) | 0.2 | 0.2 | 0.2 | 0.2 |
| Approximate amount of remaining nicotine ( % ) | 0 | 10 | 20 | 30 |

As will be clear from this table, the amount of removed nicotine can be controlled to be of any desired value in response to the concentration of the hydrogen peroxide solution contained in the filtering means so that, if the concentration is selected to be proper, some taste and flavor of the cigarette can be left appropriately.

The amount of the hydrogen peroxide solution with which the filtering means is to be impregnated should be determined in relation to the water absorbing force determined by the material, dimension and density of the filtering means to be used but is preferably selected to be in a range of 0.1 to 0.3 c.c. in the case of a concentration of 0.5 to 3% for the filtering means of an ordinarily used fiber material.

According to the present invention, as has been described above, the harmful substances contained in the smoke of cigarettes when smoked can be remarkably removed and made harmless by very simple and economical measures of impregnating a filter made, for example, of a fiber body used conventionally with a small amount of a hydrogen peroxide solution of a proper concentration and using it in a cigarette holder and the taste and flavor of the cigarette can be properly left by simply controlling the amount of the removed substance by the selection of the solution concentration. Further, in the light of the economy of the present invention, the present invention can be applied to low cost cigarette holders made, for example, of plastics and disposable.

In the case of normal holders of not disposable type, the filtering means with the impregnated hydrogen peroxide solution may be made exchangeable. In preserving the holders or exchanging filtering means with the impregnation, it will be preferable to provide a means for preventing the impregnated solution from being evaporated.

What is claimed is:

1. A cigarette holder comprising a substantially cylindrical holder body having a hollow chamber constricted to be of small diameter to define a mouthpiece at one end and having an opening at the other end dimensioned to insert therein the end of a cigarette, and a porous filter of substantially columnar shape contained in said chamber for filtering the products of combustion passing therethrough, said filter being impregnated with an aqueous hydrogen peroxide solution having a concentration in the range of 0.5 to 3.0 percent and in an amount in the range of 0.1 to 0.3 cubic centimeters.

* * * * *